US007604376B2

(12) United States Patent
Sloan et al.

(10) Patent No.: US 7,604,376 B2
(45) Date of Patent: Oct. 20, 2009

(54) FLEXIBLE PERIMETER LIGHTING APPARATUS

(75) Inventors: Thomas C. Sloan, Santa Barbara, CA (US); Bruce Quaal, Ventura, CA (US)

(73) Assignee: SloanLED, Inc., Ventura, CA (US)

( * ) Notice: Subject to any disclaimer, the term of this patent is extended or adjusted under 35 U.S.C. 154(b) by 0 days.

(21) Appl. No.: 11/729,150

(22) Filed: Mar. 27, 2007

(65) Prior Publication Data

US 2007/0171640 A1 Jul. 26, 2007

Related U.S. Application Data

(63) Continuation of application No. 10/824,890, filed on Apr. 14, 2004, now Pat. No. 7,213,941.

(51) Int. Cl.
*F21V 5/08* (2006.01)

(52) U.S. Cl. ..... 362/246; 362/240; 362/249.04

(58) Field of Classification Search ..... 362/235, 362/249, 227, 230, 231, 248, 240, 244, 246, 362/249.04, 249.08

See application file for complete search history.

(56) References Cited

U.S. PATENT DOCUMENTS

| | | | | |
|---|---|---|---|---|
| 4,439,818 | A | 3/1984 | Scheib | 362/250 |
| 4,521,839 | A | 6/1985 | Cook et al. | 362/238 |
| 4,597,033 | A | 6/1986 | Meggs et al. | 362/183 |
| 4,712,165 | A | 12/1987 | Cetrone | 362/147 |
| 5,099,401 | A | 3/1992 | Kondo et al. | 362/80.1 |
| 5,559,681 | A * | 9/1996 | Duarte | 362/252 |
| 6,158,882 | A * | 12/2000 | Bischoff, Jr. | 362/488 |
| 6,186,645 | B1 * | 2/2001 | Camarota | 362/249 |
| 6,283,612 | B1 | 9/2001 | Hunter | 362/240 |
| 6,361,186 | B1 * | 3/2002 | Slayden | 362/249 |
| 6,394,623 | B1 | 5/2002 | Tsui | 362/249 |
| 6,406,166 | B1 | 6/2002 | Ko | 362/249 |
| 6,592,238 | B2 * | 7/2003 | Cleaver et al. | 362/249 |
| 6,609,813 | B1 | 8/2003 | Showers et al. | 362/240 |
| 6,776,504 | B2 * | 8/2004 | Sloan et al. | 362/240 |

(Continued)

FOREIGN PATENT DOCUMENTS

| | | |
|---|---|---|
| CA | 2282819 | 3/2001 |

(Continued)

OTHER PUBLICATIONS

Ilight Technologies, Introducing Plexineon , A Revolutionary and Versatile Lighting System for Architectural Applications, Jun. 21, 2002.

(Continued)

*Primary Examiner*—Bao Q Truong
(74) *Attorney, Agent, or Firm*—Koppel, Patrick, Heybl & Dawson

(57) ABSTRACT

An elongated flexible lighting system according to the present invention includes an array of light sources that are illuminated by electric power. It further includes an elongated translucent extrusion of flexible material. The array of light sources is integral to the extrusion with said extrusion transmitting and dispersing the light from the array such that the lighting system gives the appearance that the array of light sources is a continuous light source. The elongated lighting system can be used for many different applications including, but not limited to, the lighting of structural features and illumination of sign features.

24 Claims, 11 Drawing Sheets

U.S. PATENT DOCUMENTS

| | | | | |
|---|---|---|---|---|
| 6,874,924 | B1 * | 4/2005 | Hulse et al. | 362/551 |
| 7,012,379 | B1 * | 3/2006 | Chambers et al. | 315/200 A |
| 2002/0191386 | A1 | 12/2002 | Cleaver et al. | |

FOREIGN PATENT DOCUMENTS

| | | | |
|---|---|---|---|
| EP | 0606006 | A | 7/1994 |
| WO | WO9906759 | A | 2/1999 |
| WO | WO0107828 | A | 2/2001 |

OTHER PUBLICATIONS

Patent Abstracts of Japan, vol. 2002, No. 10., Oct. 10, 2002, Moriyama Sang OKK, Publication No. 2002163907, Nov. 24, 2000 "Light System and Lighting Unit".

* cited by examiner

FLEXIBLE PERIMETER LIGHTING APPARATUS

This is a continuation application from, and claims the benefit of, U.S. patent application Ser. No. 10/824,890, filed on Apr. 14, 2004, and now issued as U.S. Pat. No. 7,213,941.

BACKGROUND OF THE INVENTION

1. Field of the Invention

This invention relates to an elongated lighting system and more particularly to an elongated and flexible lighting system using light emitting diodes as its light source.

2. Description of the Related Art

Perimeter or border lights ("perimeter lighting") are commonly used on buildings to accentuate the structure, to draw customer attention to the building, and to provide safety lighting. Lighted signs are also commonly used with business to advertise products or to indicate whether the business is open or closed. Most conventional perimeter lighting systems and lighted signs use neon or fluorescent bulbs as the light source. Some of the disadvantages of these bulbs are that they have a relatively short life, are fragile and can consume a relatively large amount of power. Also, neon bulbs can experience difficulty with cold starting, which can lead to the bulb's failure.

Developments in light emitting diodes ("LEDs") have resulted in devices that are brighter, more efficient and more reliable. LEDs are now being used in many different applications that were previously the realm of incandescent bulbs; some of these include displays, automobile taillights and traffic signals. As the efficiency of LEDs improve it is expected that they will be used in most lighting applications.

LEDs have been used in strip lighting applications. U.S. Pat. No. 4,439,818 to Scheib discloses a lighting strip that utilizes LEDs as the light source. The strip is flexible in three dimensions and is useful in forming characters and is capable of providing uniform illumination regardless of the characters selected for display. The strip comprises a flexible multi-layered pressure sensitive adhesive tape, having a plurality of triangle cutout sections on each side of the tape, with LEDs connected in a series with a resister. One disadvantage of this strip is that it cannot be cut to different lengths for different applications. Instead, different lengths of the strip must be used. Further, the light from the LEDs is not diffused to give the appearance of neon light, instead showing lighting "hot spots" along its length. This arrangement is not durable enough to withstand the conditions for outdoor use. The flexible tape and its adhesive can easily deteriorate when continually exposed to the elements.

U.S. Pat. No. 5,559,681 to Duarte, discloses a flexible, self adhesive, light emissive material that can be cut into at least two pieces. The light emissive material includes a plurality of light electrically coupled light emissive devices such as light emitting diodes. The material also includes electric conductors for conducting electric power from a source of electric power to each of the light emissive devices. While this lighting arrangement is cuttable to different lengths, the light it emits is not dispersed so that it resembles neon light. This arrangement is also not durable enough to withstand the conditions for outdoor use.

Flexible strip lighting using light bulbs has also been developed. U.S. Pat. No. 4,521,839 to Cook et al. discloses a strip lighting system comprising a string of electrically connected light bulbs contained within a flexible tube. The tube is of a waterproof material and is sealed at each end by a removable plug, so that the string of bulbs can be removed when necessary to be repaired or replaced.

One of the disadvantages of this strip lighting is that it is not suitable for replacing neon type perimeter lighting because the light from the individual light bulbs is not diffused and dispersed to give the appearance of a neon light source. Furthermore, no mechanism is disclosed for mounting the strip lighting to a structure. Another disadvantage is that the strip lighting uses light bulbs instead of LEDs, and light bulbs generally have a shorter life span and can consume more power than LEDs.

PCT International Application Number PCT/AU98/00602 discloses a perimeter light that uses LEDs as its light source and includes a light tube structure in which multiple LEDs are arranged within an elongated tube that diffuses or disperses the light from the LEDs. The perimeter light is used to highlight or decorate one or more features of a structure, such as a roof edge, window, door or corner between a wall or roof section.

One of the disadvantages of this light is that it is not flexible and that it cannot be cut to match the length of a building's structural features. Instead, the perimeter lighting must be custom ordered or is mounted without fully covering the structural feature. Also, the connectors between adjacent sections of lighting are bulky and result in a visible junction between the sections. The light's tube also significantly attenuates the light emitted by its LEDs, significantly reducing the light's brightness. There is also no apparatus or method for providing perimeter lighting that can be bent to match a curved structural feature of a building.

SUMMARY OF THE INVENTION

One embodiment of an elongated flexible lighting system according to the present invention comprises an array of light sources that are illuminated by electric power. It further comprises an elongated translucent extrusion of flexible material. The array of light sources is integral to the extrusion with said extrusion transmitting and dispersing the light from the array such that the lighting system gives the appearance that the array of light sources is a continuous light source.

One embodiment of a system for lighting structural features according to the present invention comprises a plurality of elongated flexible lighting systems, each of which includes an array of light sources that are illuminated by electric power. Each also includes an elongated translucent extrusion of flexible material with the array of light sources integral to the extrusion. The extrusion transmits and disperses light from the array giving the appearance that the array of light sources is a continuous light source. The flexible lighting systems can be coupled in a daisy-chain with the electrical power transmitted to each of the flexible lighting systems. A mechanism for anchoring the flexible lighting systems to a structure is also included.

One embodiment of an illuminated sign according to the present invention comprises a plurality of sign features formed using at least one elongated flexible lighting system. Each of the elongated lighting features comprises an array of light sources that are illuminated by electric power. Each also comprises an elongated translucent extrusion of flexible material with the array of light sources integral to the extrusion. The extrusion transmits and disperses light from the array giving the appearance that the array of light sources is a continuous light source. The flexible lighting systems are coupled in a daisy-chain with the electrical power transmitted to each of said flexible lighting systems. A mechanism is also included for anchoring said flexible lighting systems in the shape of the sign features.

These and other further features and advantages of the invention will be apparent to those skilled in the art from the following detailed description, taken together with the accompanying drawings, in which:

DETAILED DESCRIPTION OF THE INVENTION

Figure 1:
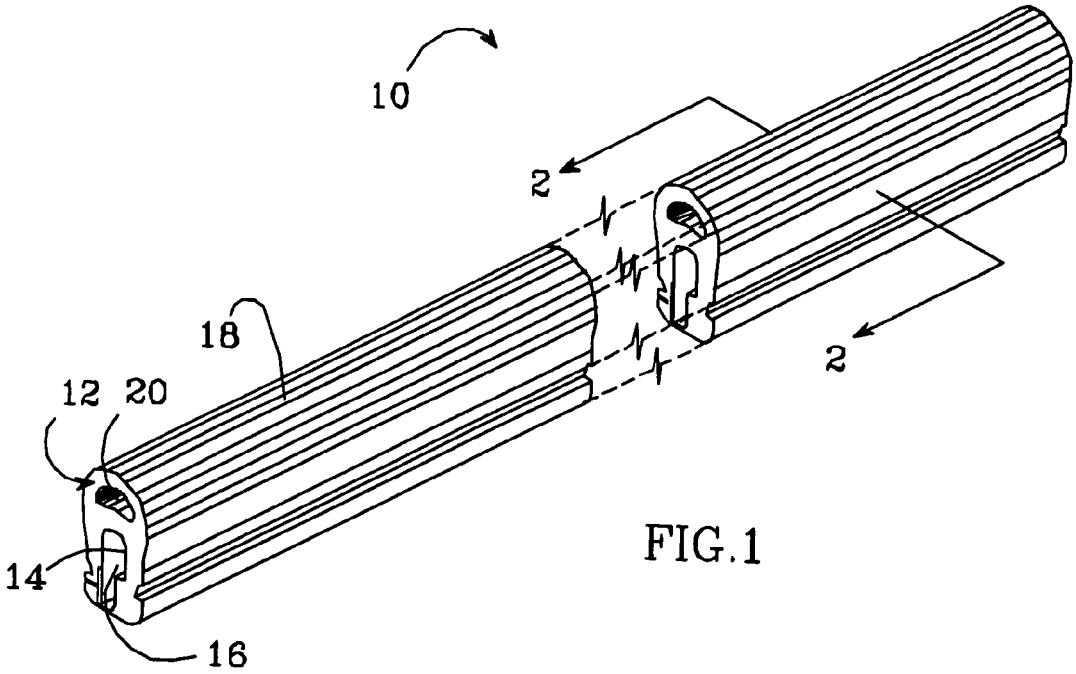
FIG. 1 is a perspective view of one embodiment of a elongated flexible lighting system according to the present invention.
Figure 2:
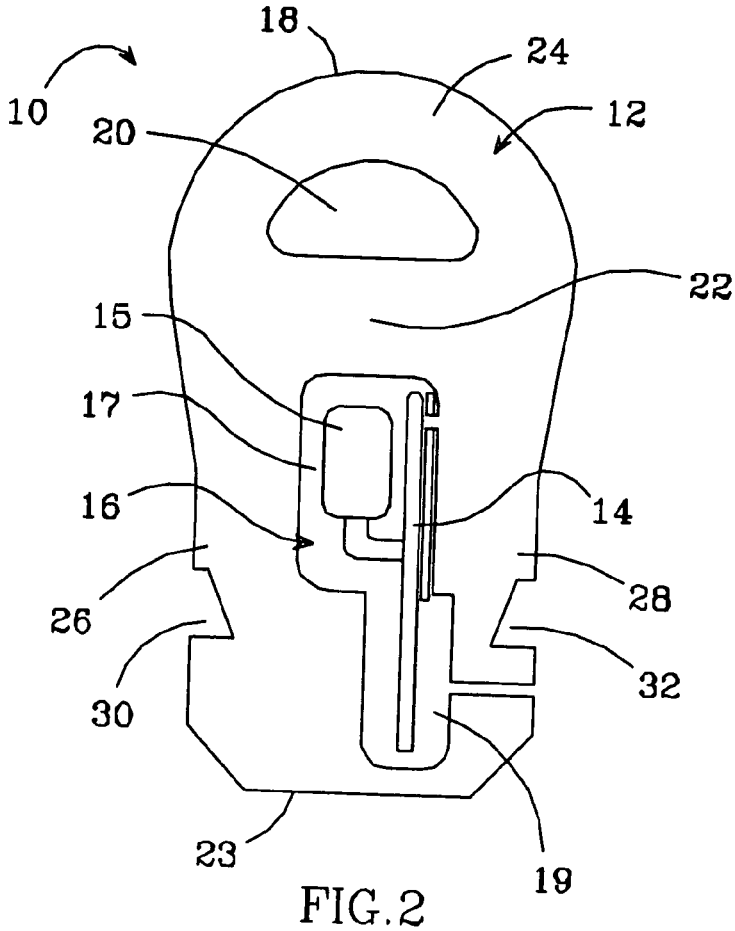
FIG. 2 is a sectional view of the lighting system in FIG. 1, taken along section lines 2-2.

FIGS. 1 and 2 show one embodiment of a flexible lighting system 10 according to the present invention that generally comprises an elongated flexible extrusion 12 and an elongated flexible printed circuit assembly 14. The extrusion 12 can be many shapes and sizes, but is preferably sized to replace conventional neon lighting. Some standard sizes for neon lighting include, but are not limited to, 12 millimeter (mm), 15 mm, and 18 mm, and the extrusion can be sized accordingly to appear as these lights. The lighting system should also have optical properties designed to match and replace industry standard neon lights. The lighting systems according to the present invention can use light sources (such as LEDs) that are more efficient and have a longer life than conventional neon lights. The resulting lighting system can cost less over its lifetime, consume less power, and require less maintenance, compared to conventional neon lighting.

The printed circuit assembly 14 is mounted integrally with the flexible extrusion 12, preferably in a lower longitudinal cavity 16 in the extrusion 12, although the PCB can be arranged in many different ways adjacent to or within the extrusion 12 and can be formed as part of the extrusion 12. The printed circuit assembly 14 can be mounted vertically within longitudinal cavity 16 and can hold light sources 15 (shown best in FIG. 2) directed up toward the top rounded surface 18 of the extrusion 12. The lower longitudinal cavity 16 can have a cross-section with many different shapes and sizes to match different arrangements of light sources 15 on the printed circuit assembly 14. The longitudinal cavity 16 has a larger upper portion 17 to house the upper part of the printed circuit material 14 and the lighting sources 15. The longitudinal cavity 16 also has a smaller lower portion 19 to house the lower part of the printed circuit material 14 and any electronic components mounted thereto.

The longitudinal cavity 16 is preferably arranged to completely enclose the printed circuit material 14, with a cavity slot 16 provided for insertion of the printed circuit material 14 into the lower longitudinal cavity 16 during the assembly process. The longitudinal cavity 16 can then be filled with a potting material to cover, seal and protect the printed circuit assembly 14, with a suitable potting material being silicone. Alternatively, the printed circuit assembly 14 can be conformal coated for protection prior to being installed in the longitudinal cavity.

When mounting the extrusion 12 to a structural feature or as part of a sign, it is preferable to place the extrusion's bottom flat surface 23 against the mounting surface. The extrusion 12 with its flexible printed circuit assembly 14 and light sources 15 are arranged so that when the light sources are emitting, the perimeter lighting appears similar to neon lighting. The lighting system 10, however, provides a number of advantages beyond conventional neon lights, only one of which is that it can be bent into tight curves, with some embodiments being capable of bending to a radius of less than 1" radius. The lighting system 10 provides a further advantage of returning back to straight if the bending force is removed. The lighting system is arranged such that it can be repeatedly bent and returned without damage to or failure to the extrusion 12 and/or the printed circuit assembly 14.

The lighting system 10 has features that also allow it to appear as a continuous light source, with no lighting "hot spots" from its light sources 15. As best shown in FIG. 2, the extrusion 12 contains an upper longitudinal cavity 20 arranged between the printed circuit assembly 14 and the extrusions top surface 18. The upper cavity 20 has a generally semicircle cross section, although other cross sections can also be used. At least some of the light from the light sources 15 passes through the upper longitudinal cavity 20 before exiting from the top surface 18. The upper longitudinal cavity 20 provides for "secondary optics", which help to diffuse the light from the light sources 15. The light from the light sources 15 first passes through the extrusion middle layer 22. It then passes into upper cavity 20 and because of the different indexes of refraction from the middle layer 22 and the upper cavity 20, the light is refracted. This results in the light diffusing as it passes through the cavity 20. The light then passes into the extrusion top layer 24 where it is further diffused because of the change in indexes of refraction. Finally, the light emits from the top surface 18, where it is again diffused. This arrangement helps diffuse the light that eventually emits through the top surface 18, helping the lighting system 10 to exhibit its translucent characteristics. The extrusion's 12 can also have the opacity to further diffuse but not over-attenuate the emitting light. The extrusion's opacity along with its secondary optics allow the lighting system 10 to appear as conventional neon lighting. To provide the maximum light emission from the light sources 15, the extrusion 12 should have filter characteristics that transmit primarily the wavelength of the light emitted from the light sources.

It is understood that the upper cavity 20 can have many different shapes and sizes and that lighting systems according to the present invention can be provided without upper cavities. Other mechanisms for diffusing the light can also be included such as scattering particle of voids.

The extrusion 12 also comprises first and second sides 26, 28 that can be made thicker than the middle and top layers 22, 24, to give the perimeter lighting, additional mechanical strength and to also block and absorb light from the light sources 15 that emits through the sides 26, 28. This reduces the amount of light that passes through the sides 26, 28 and reduces/eliminates the light hot spots visible at the sides. The primary light emitted by the lighting system 10 is through the extrusion top surface 18.

The light sources 15 are preferably LEDs, although many other light sources can be used including, but not limited to, incandescent bulbs or solid state lasers. The LEDs can emit different wavelengths of light including, but not limited to, red, amber, yellow, green, blue and white. Each light source can also be an LED capable of emitting multiple colors of light such as red, green and blue. The multiple colors can be emitted individually or in combination to produce different color combinations of red, green and/or blue. In one embodiment, the red, green and blue colors can emit simultaneously to emit a white light combination of the colors. The intensity of each of the colors can also be controlled, with the color changing and varying intensity manipulated by an electronic controller.

The extrusion 12 is formed using known extruding methods and can be made of many different flexible materials, with a preferred material being resilient and withstanding repeated flexing without damage or failure. The material should also be rugged, UV stable and capable of withstanding hot, cold, wet and dry environmental conditions, such that it can be used both inside and outside. The material should also be capable of being formed in many different colors and should experience only a small thermal expansion. A suitable extrusion material is silicone, although many other materials can also be used.

The extrusion 12 can be mounted in place using many different methods including, but not limited to, gluing, screwing, nailing or clamping. In one mounting method according to the invention, the extrusions contain first and second grooves 30, 32, each of which is on a respective one of the sides 26, 28 of the extrusion 12, near the bottom. As more fully described below in FIGS. 6-9, the grooves 30, 32 mate with mounting brackets having lips. The brackets are first mounted to the structure, and the extrusion 12 snaps into the brackets with a respective one of the bracket lips disposed within one of the grooves 30, 32.

Figure 3:
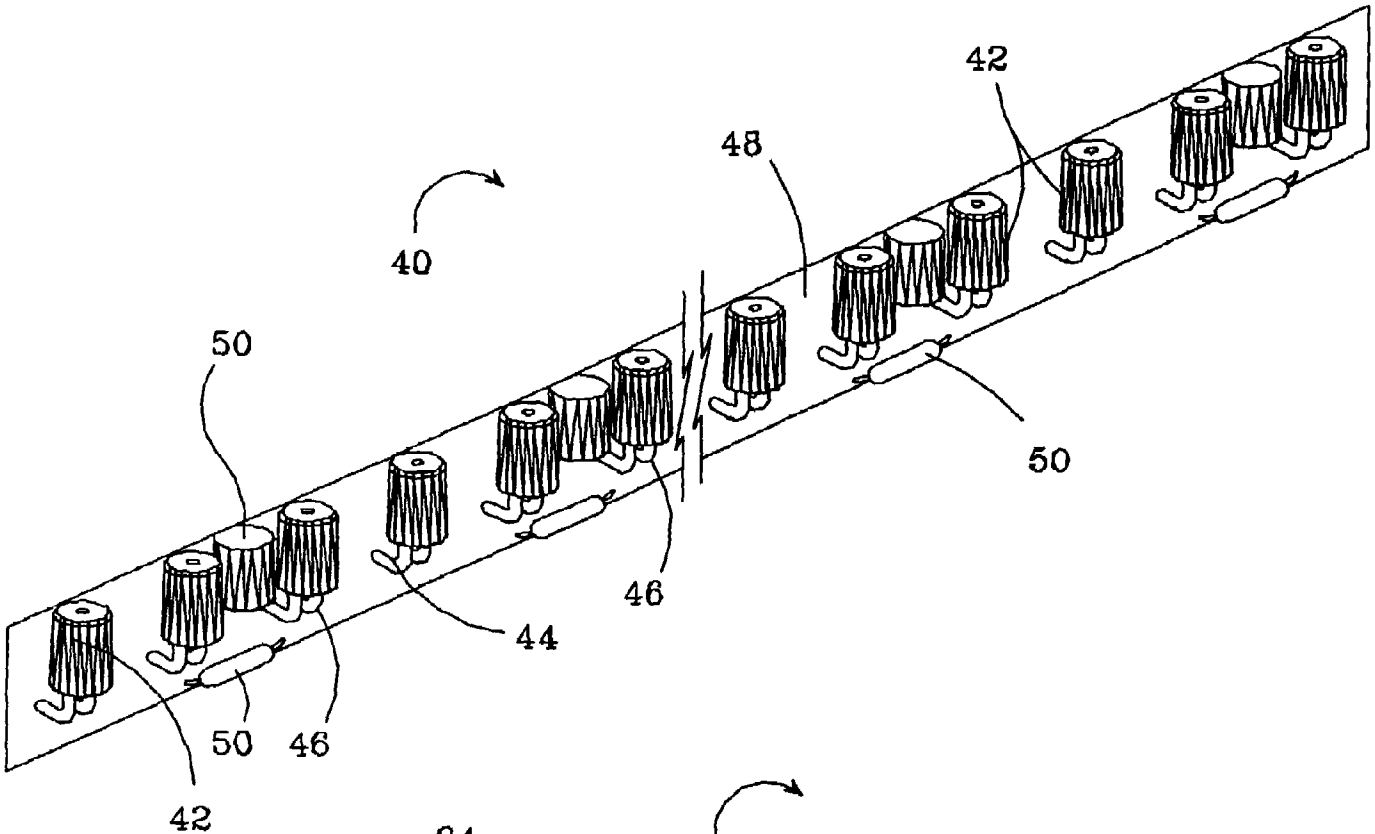
FIG. 3 is a perspective view of one embodiment of printed circuit assembly according to the present invention that can be used in flexible perimeter light of FIG. 1.

FIG. 3 shows one embodiment of a printed circuit assembly 40 according to the present invention having light sources 42 that are preferably LEDs, although other light sources can also be used. The LEDs 42 can emit different colors and combinations of light as described above, and can be different types of LEDs such as surface mount and bi-pin through hole mounted LEDs. The LEDs 42 shown in FIG. 3 are bi-pin through hole mounted LEDs, with each of the LEDs 42 having first and second mounting pins 44, 46 that are each bent at approximately a 90 degree angle. The ends of the first and second mounting pins 44, 46 are coupled to a flexible printed circuit material 48 that can be made of any many different flexible materials having conductive traces, such as commercially available FR4 and Capton. By bending the first and second mounting pins 44, 46 the LEDs can be mounted to the printed circuit material 48 with the LEDs 42 emitting up when the printed circuit assembly 40 is in its vertical orientation as shown. The angled pins also reduce failure that can occur from repeated flexing of the assembly 40. The printed circuit material 48 includes conductive traces that interconnect the LEDs 42 and other electronic devices 50. The devices 50 can be many electronic components including, but not limited to, resistors, voltage regulators, capacitors, inductors, transformers, etc.

Figure 4:
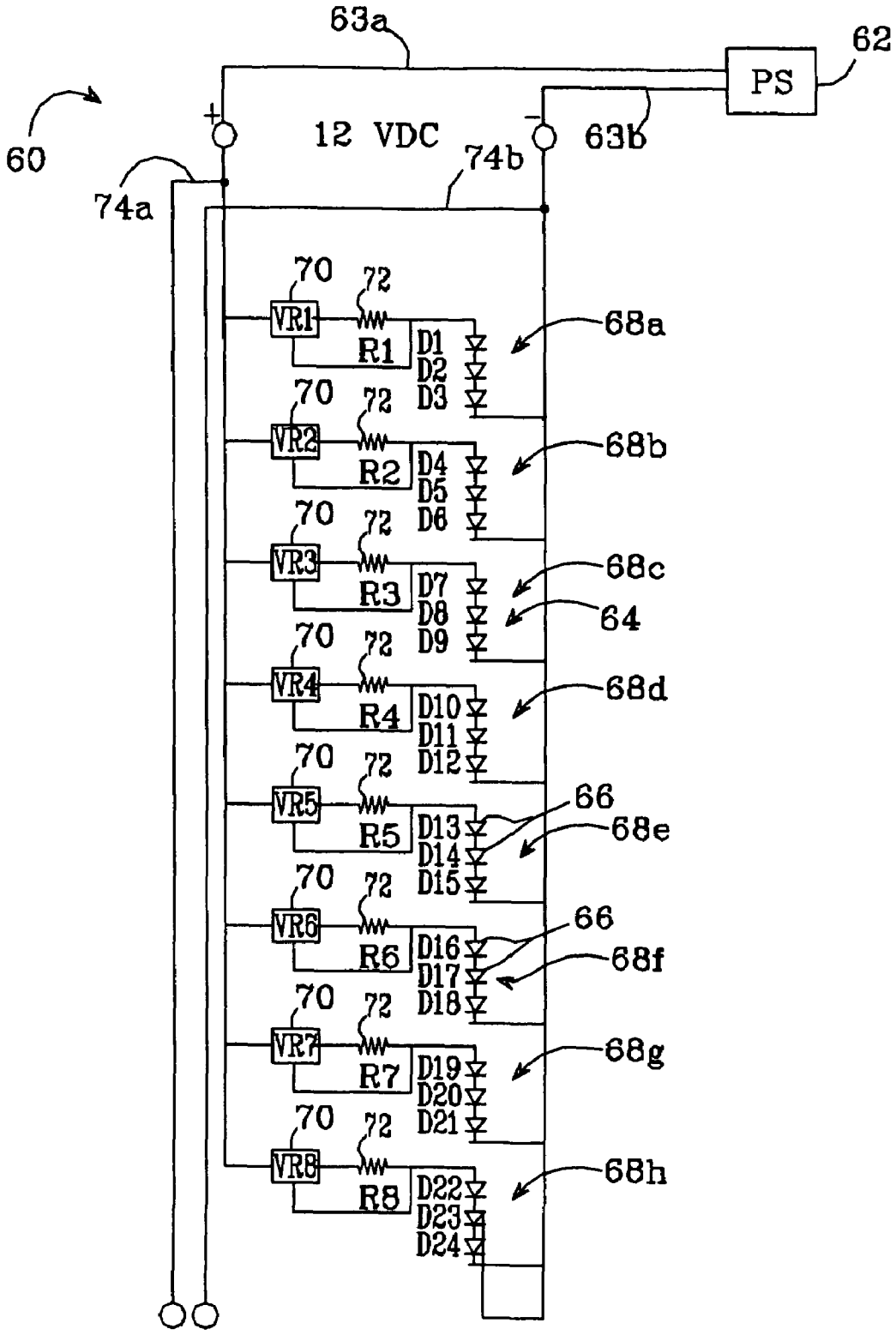
FIG. 4 is a schematic of one embodiment of the components and interconnects of a printed circuit assembly according to the present invention.

FIG. 4 is a schematic showing the electronic components and interconnects for one embodiment of a printed circuit assembly 60 according to the present invention. A power supply 62 provides power to the assembly 60, which can operate from many different low or high voltage AC or DC supplies. A suitable power supply 62 can provide 12 volt (V) DC power and in one embodiment a step down transformer (not shown) is used to reduce the typical 120V AC power to the suitable 12V DC.

The power supply 62 can be connected to the assembly 60 along conventional conductors or wires 63*a*, 63*b*. The 12V DC power is then applied to an LED array 64, which, in different embodiments, can comprise different numbers of LEDs 66 emitting in different colors. In the assembly 60, the LED array comprises 24 LEDs, which are grouped into eight LED sub-arrays 68*a-h*, each having three LEDs. In other embodiments the LED array 64 can include a different number of LEDs and sub-arrays, each of which can have more or less LEDs.

Each of the sub-arrays 68*a-h* is arranged in parallel with the others and each includes a voltage regulator 70 and a resistor 72. Each voltage regulator 70 is arranged so that the same voltage is available at each sub-array 68*a-h*, with a suitable voltage being approximately 1.25V. Many different voltage regulators can be used, with a suitable voltage regulator being the commercially available LM317L 3-Terminal Adjustable Regulator, provided by National Semiconductor Corporation.

A different resistor 72 can be used at each of the sub-arrays 68*a-h* depending on the voltage supplied by each voltage regulator 70 and the desired current to be applied to each sub-array 68*a-h*. For different colors of LEDs the desired current can be different. A suitable current to apply to each sub-array is 30 milliamps (mA), which results in suitable resistor 70 being 42 Ohms.

The voltage regulator 70 and sub-array arrangement 68*a-h* allows the LEDs 62 to illuminate with substantially the same luminous flux. Without this arrangement, the array 64 could experience line loss such that the initial LEDs in the array could emit a greater luminous flux compared to those further down the array. This would result in the overall lighting system appearing brighter at one end. The voltage regulator 70 at each sub-array 68*a-h* provides the same voltage at each sub-array 68*a-h*, and if each resistor 72 is the same, substantially the same current is applied to the LEDs in each sub-array 68*a-h*. A lighting system using the assembly 60 will have substantially uniform brightness along its length.

The circuit assembly 60 transfers the 12V power from the one end to the other and around the sub-arrays 68*a-h* along first and second daisy-chain conductors 74*a*, 74*b*. The conductors 74*a*, 74*b* can then be connected to another next circuit assembly 60 in line, i.e. the conductors 74*a*, 74*b* can provide the 12V DC power supply to the next circuit assembly 60. This allows a plurality of lighting systems to be "daisy chained" together to illuminate longer structural features or to form a number of sign features. Each circuit assembly 60 typically comprises a flexible printed circuit material that is 12 inches long to hold the LEDs and electronic components. The circuit assembly 60 typically is mounted within and illuminates 12 inches of flexible extrusion. A conventional 12V DC power supply can power up to 20 circuit assemblies and can accordingly illuminate up to 20 feet of extrusion. Other power supplies can power greater lengths of circuit assemblies 60 and the use of different electronic components can increase or decrease the length of circuit assemblies that can be powered.

As mentioned above, one of the advantages of the new lighting system 10 is that it can be cut to match the length of a particular structural feature or to form different letters. This provides the ability to mount the flexible lighting system 10 on various structural features or to form various letters, without having to special order different lengths of lights to match the application. Each of the sub-arrays 68*a-h* typically covers approximately 1.5 inches on its flexible printed circuit material and the printed circuit material can be cut between each of the sub-arrays 68*a-h*, while allowing the remaining sub-arrays to emit light. This allows each of the 12 inch lengths in the lighting system 10 to be cut in the field in increments of 1.5 inches. Longer lengths of the lighting system can also be cut at 12 inch increments, essentially between each daisy chained printed circuit assembly 60. This provides the advantage of allowing the daisy chain conductors 74*a*, 74*b* that would otherwise pass to the cut away section from the remainder of the light system, to be revealed. The cut-away section can then be re-used by coupling the revealed conductors to a 12V DC power supply. This helps reduce waste when the light system is being cut in the field.

The flexible extrusion can contain marks along its length, preferably along its bottom surface, to designate the proper locations for cutting between sub-arrays 68*a-h*. For instance, one of the marks corresponds to the location between LED sub-arrays 68*b* and 68*c* so that cutting at the mark would remove parallel LED sub-arrays 68*c-h*, leaving sub-arrays 68*a* and 68*b* to emit light.

In another embodiment of a printed circuit assembly according to the present invention, the LEDs can be surface mount LEDs, instead of the bi-pin LEDs. In this embodiment the surface mount LEDs can be side emitting such that they emit up when the printed circuit assembly is in its vertical orientation. The surface mount LEDs can also be designed to have a wide viewing angle and high intensity, with the pitch of the LEDs optimized for even light intensity. The LEDs can also be mounted on the flexible printed circuit material and centered in the extrusion.

Figure 5:
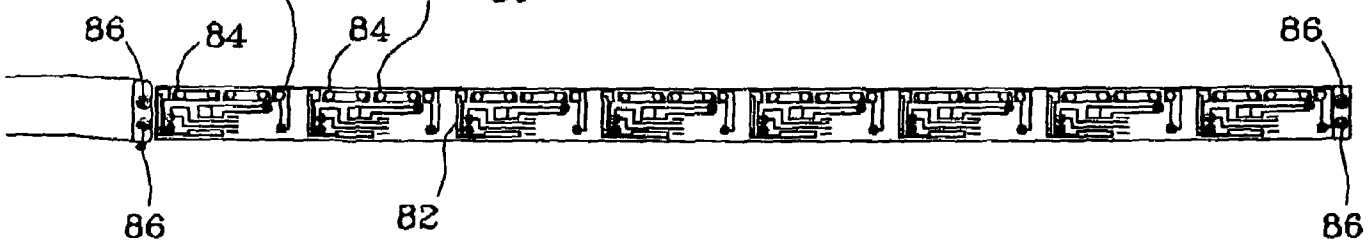
FIG. 5 is a plan view of one embodiment of a flexible printed circuit material and conductive traces according to the present invention.

FIG. 5 shows one embodiment of a flexible printed circuit material 80, with traces 82 arranged for surface mount LEDs. According to the invention, redundant conductive paths or traces 82 are provided to and from each surface mount pad 84 to add reliability during flexing of the lighting system. The redundant traces are in opposing 90° directions so that if one trace cracks during flexing the other traces will still conduct current to the mount pad 84. Through hole vias are used on the surface mount of the pad 84 to mechanically fix the pad to the printed circuit material. This keeps the pad 84 from lifting off the printed circuit material and breaking the trace. The printed circuit material 80 can also be arranged in sub-arrays of LEDs that allow the material 80 to be cut in the field. Through hole pads 86 are used at each end of the printed circuit material 80 to mechanically and electrically connect multiple printed circuit materials together in a daisy-chain. This allows the daisy-chained materials 80 to be used to illuminate different lengths of flexible extrusion or sign features.

Figure 7:
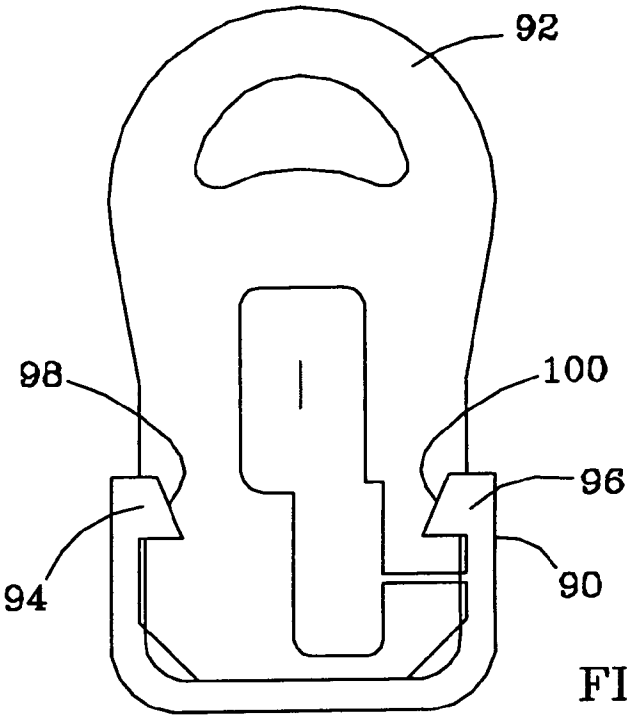
FIG. 7 is an elevation view of one embodiment of a flexible lighting system according to the present invention mounted in the bracket of FIG. 6.
Figure 6:
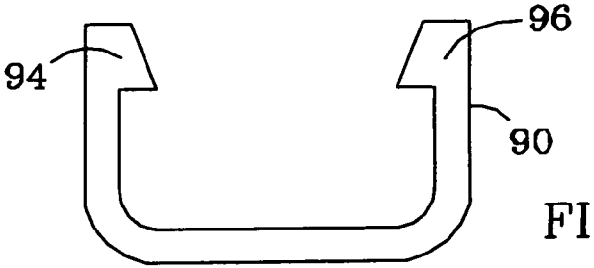
FIG. 6 is an elevation view of one embodiment of a mounting bracket according to the present invention.

FIGS. 6 and 7 show one embodiment of a mounting clip 90 according to the present invention that can be used to mount the flexible lighting system 92 according to the present invention, although many other mounting devices/methods can be used including, but not limited to, clamps, screws, glues, buttons, etc. The clip 90 can be different lengths depending on the desired curve for the lighting system 92. The clip 90 contains inward facing and opposing first and second lips 94, 96, that are located to fit within a respective one of the first and second grooves 98, 100 in the lighting system 92. The clip can be mounted in the desired location using many different known mounting methods, including but not limited to, screws, nails, glue, clips or clamps. Once the clip 90 is mounted in place the lighting system 92 is pushed into the clip 90 until the first and second lips 94, 96 mate with their respective one of the first and second grooves 98,100. The lip and groove arrangement holds the lighting system 92 within the clip 90. For curved applications of the lighting system 92, a number of shorter length clips 90 can be mounted along the desired curve and the light system 92 can be mounted along a straight line or one or more longer clips can be used.

Figure 9:
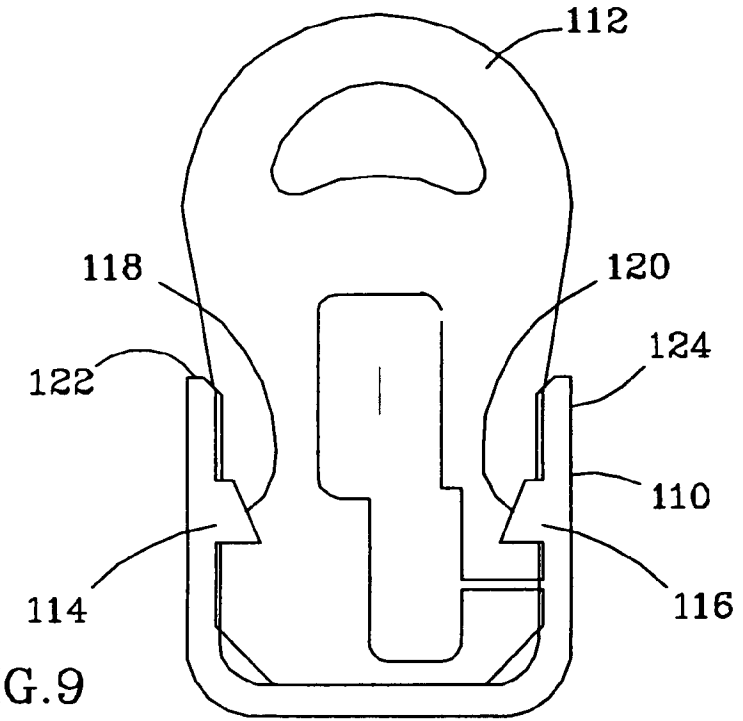
FIG. 9 is an elevation view of one embodiment of a flexible lighting system according to the present invention mounted in the bracket of FIG. 8.
Figure 8:
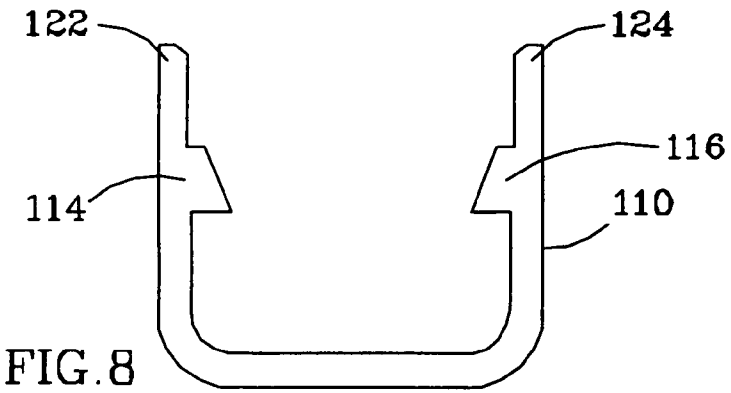
FIG. 8 is an elevation view of another embodiment of a mounting bracket according to the present invention.

FIGS. 8 and 9 show another embodiment of a clip 110 according to the present invention that is also used for mounting different embodiments of a flexible lighting system 112 according to the present invention. The clip 110 is similar to the clip 90 above and has first and second opposing lips 114, 116 to mate with first and second grooves 118, 120 to hold the lighting system in the clip 110. The clip 110, however, also comprises first and second vertical extensions 122, 124 that extend above the opposing lips 114, 116, to provide lateral support to the sides of the lighting system 112. The clip 110 can be made of clear material or can be opaque to block light emitting through the side surfaces.

Figure 10:
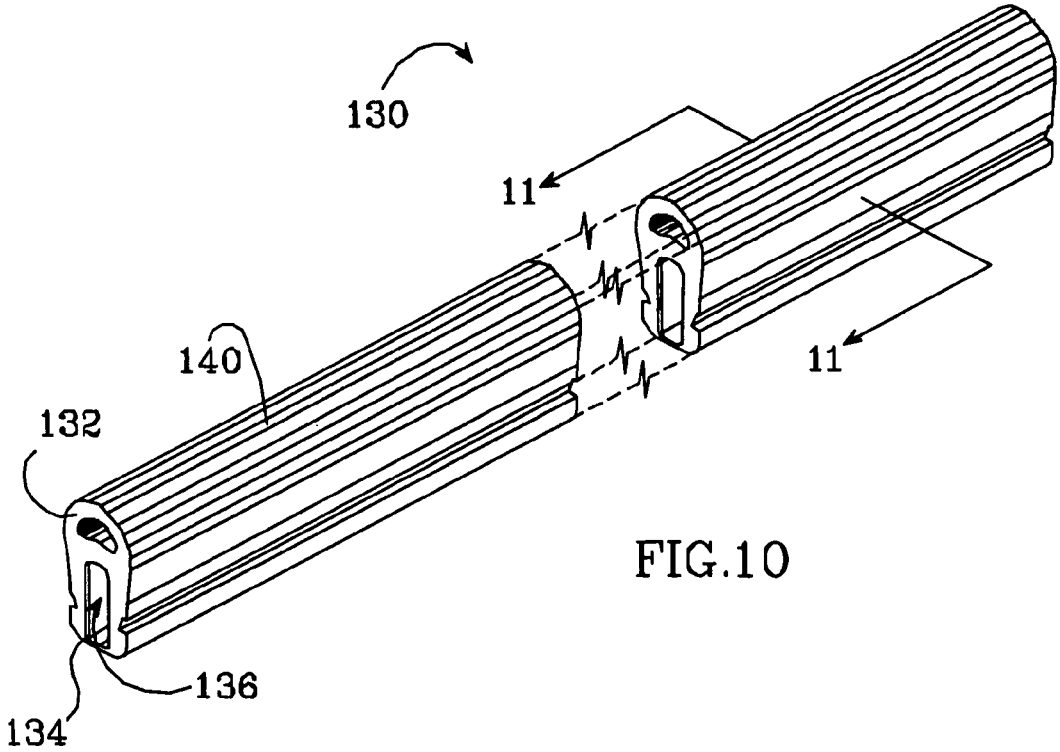
FIG. 10 is a perspective view of another embodiment of a flexible lighting system according to the present invention.
Figure 11:
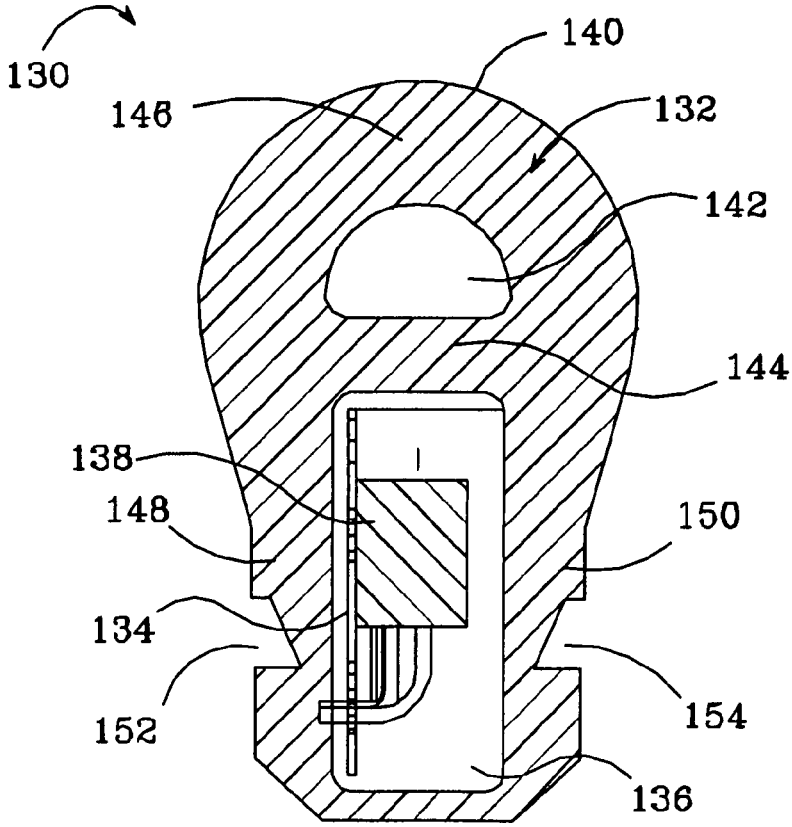
FIG. 11 is a sectional view of the flexible lighting system of FIG. 10, taken along section lines 11-11.

FIGS. 10 and 11 show another embodiment of a flexible lighting system 130 according to the present invention that is similar to lighting system 10 described above and generally comprises an elongated flexible extrusion 132. It also comprises an elongated flexible printed circuit assembly 134 mounted integrally with the flexible extrusion 132, preferably in the extrusion's longitudinal lower cavity 136. Alternatively, the assembly 134 can be arranged in many different ways adjacent to or within the extrusion 132. The printed circuit assembly 134 is arranged vertically within the lower longitudinal cavity 136 and also holds LEDs 138 directed up toward the top rounded surface 140 of the extrusion 132, such that light from the LEDs 138 primarily emits out the top surface 140.

The lower longitudinal cavity 136 has a rectangular cross-section that can be formed with or without a longitudinal opening/slot to allow insertion of the printed circuit assembly. In those embodiments that do not contain a slot, a slot can be cut along the lower longitudinal cavity 136 to provide the opening for insertion of the printed circuit assembly 134. The preferred location for the slot is along the bottom surface of the extrusion 132, through to the cavity 136, although the slot can be in many different locations. The slot can be cut using many different methods, such as cutting with a razor or knife. The printed circuit assembly 134 is preferably inserted into the longitudinal cavity 136, through the slot with the LEDs 138 directed up toward the extrusion's top surface. The longitudinal cavity can then be filled with a potting material, such as silicone, to surround and protect the printed circuit assembly 134 and its components. In other embodiments, the printed circuit assembly 134 can be slid into the longitudinal cavity 136 through one of its openings. Printed circuit assembly 134 can have many different components and can be formed of many different materials, with a preferred circuit assembly 134 being similar to the assembly 14 shown in FIGS. 1-3 and describe above.

The lighting system 130 also has features similar to lighting system 10 that allow it to appear as conventional neon lighting. The extrusion 132 contains an upper longitudinal cavity 142 arranged between the printed circuit material 134 and the extrusions top surface 140. The upper longitudinal cavity 142 has a generally semicircle cross section and light from the LEDs 138 passes through the second longitudinal cavity 142 before exiting from the top surface 140. Similar to the upper longitudinal cavity 20 shown in FIGS. 1 and 2, the upper longitudinal cavity 142 and the middle and upper extrusion layers 144, 146 allow for "secondary optics", which helps refract and diffuse light from the LEDs. This arrangement helps diffuse the light without absorbing most of it, helping the lighting system 130 to exhibit its translucent characteristics and to appear as conventional neon lighting. To provide the maximum light emission from the LEDs 138 on the printed circuit assembly 134, the extrusion 132 should have filter characteristics that transmit primarily the wavelength of light emitted from the LEDs 138.

Similar to the lighting system 10, the lighting system 130 has first and second sides 148, 150 that can be made thicker than the middle and upper layers 144, 146, which gives the perimeter lighting mechanical strength and also helps block and absorb light from the light sources that emits out the sides 148, 150 of the extrusion 132. This allows most of lighting system's emitted light to be the diffused light emitting out the extrusion top surface 140.

Similar to LEDs 15 above, the LEDs 138 can emit different wavelengths of light including, but not limited to, red, amber, yellow, green, blue and white. Each light source can also be an LED capable of emitting multiple colors of light such as red, green and blue. The emission and intensity of each of the colors can be controlled, with the color changing and varying intensity manipulated by an electronic controller.

Figure 13:
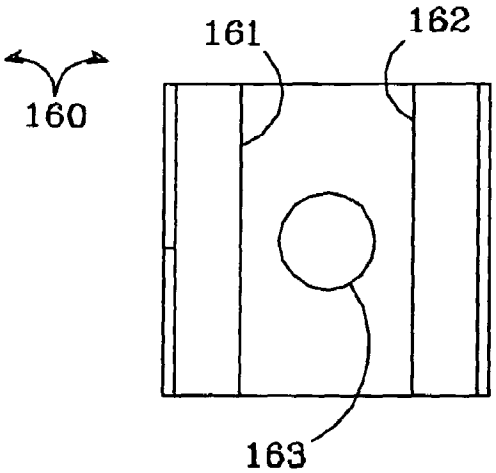
FIG. 13 is a plan view of the bracket in FIG. 12.
Figure 12:
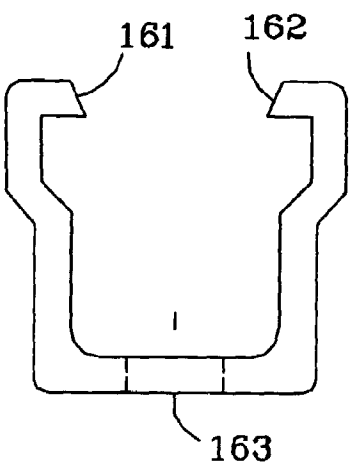
FIG. 12 is an elevation view of a mounting bracket according to the present invention.

The extrusion 132 can be formed using the same methods as extrusion 12 and can be made of the same material, such as silicone. The extrusion 132 can be mounted in place in many different ways including, but not limited to, gluing, screwing, nailing or clamping. In one mounting method according to the invention, the extrusion 132 contains first and second longitudinal grooves 152, 154, each of which is on a respective one of the extrusion side surfaces. Referring also to FIGS. 12 and 13 which show a mounting bracket 160, the first and second grooves 152, 154 are arranged to mate with the first and second opposing lips 161, 162 for mounting the lighting system 130. The bracket 160 can be first mounted to the location where the lighting system is to be mounted, such as to a structure or as part of a sign. The bracket 160 can be mounted using many different mounting methods, with a suitable method being screwing or nailing the bracket 160 in place through mounting hole 163. The extrusion 132 snaps into the bracket 160 with a respective one of the bracket lips 161, 162 disposed within one of the first and second grooves 152, 154. The bracket 160 can be made of many different materials, with a suitable material being acrylic, and can be formed using known methods.

For curved applications of the lighting system 130, a number of shorter length clips 160, as shown in FIGS. 12 and 13, can be mounted along the desired curve and the light system 130 can be mounted in the clips 160 to hold it in the desired curve. For straight applications, a number of shorter length clips 160 can be mounted along a straight line or one or more longer clips can be used.

Figure 14:
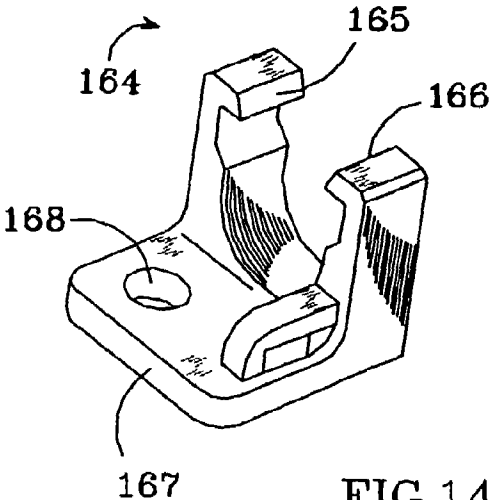
FIG. 14 is perspective view of still another mounting bracket according to the present invention.

FIG. 14 shows still another embodiment of a mounting bracket 164 that can be used to mount lighting systems according to the present invention and comprises first and second opposing lips 165, 166 to mate with the extrusion grooves 152, 154 to hold the extrusion within the bracket. The bracket 164 further comprises a mounting base 167 having amounting hole 168 for nailing or screwing the bracket in place.

Figure 15:
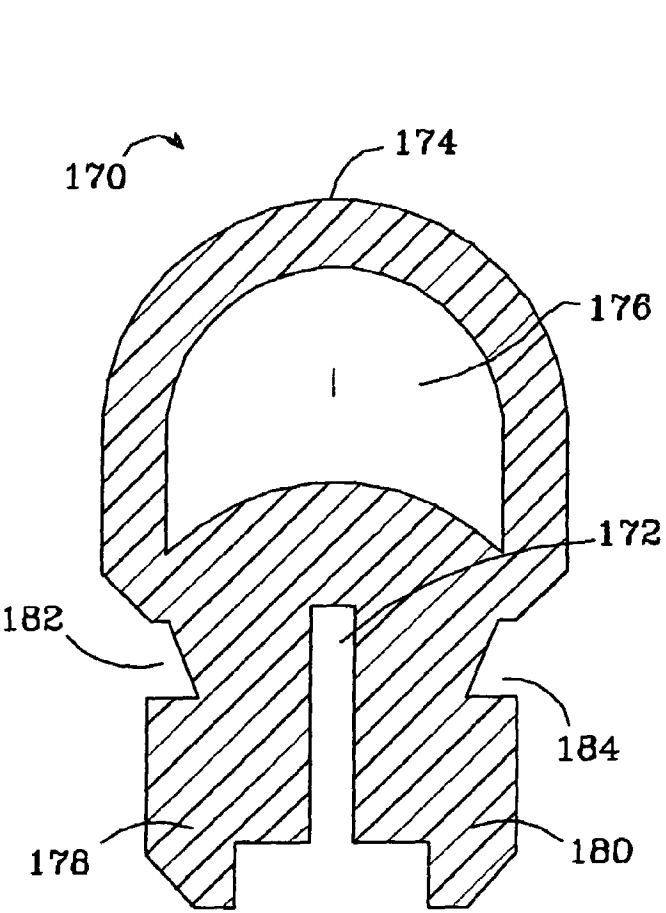
FIG. 15 is an end view of another flexible extrusion according to the present invention.

FIG. 15 shows still another embodiment of extrusion 170 that can be used in flexible lighting systems according to the present invention. It comprises a lower cavity 172 for holding a printed circuit assembly (not shown) having LEDs directed to its top surface 174 that is then encased in a potting material in the cavity 172 to protect the circuit assembly and its components. The extrusion also has upper longitudinal cavity 176 having a crescent cross-section to provide secondary optics to refract and diffuse light from the LEDs.

The extrusion 170 has first and second sides 178, 180 that can be made relatively thick to give the extrusion mechanical strength and also helps block and absorb light from out the sides 178, 180 of the extrusion 170. The extrusion 170 can be formed using the same methods as extrusions 12 and 132 described above, and can be made of the same material, such as silicone. The extrusion 170 further comprises first and second longitudinal grooves 182, 184, each of which is arranged to mate with a bracket lip for mounting the extrusion 170.

Figure 16:
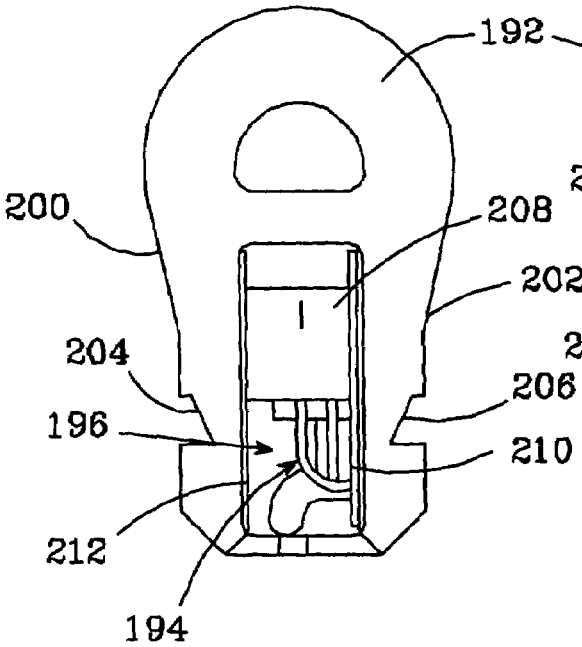
FIG. 16 is a sectional view of another embodiment of a flexible lighting system according to the present invention.
Figure 17:
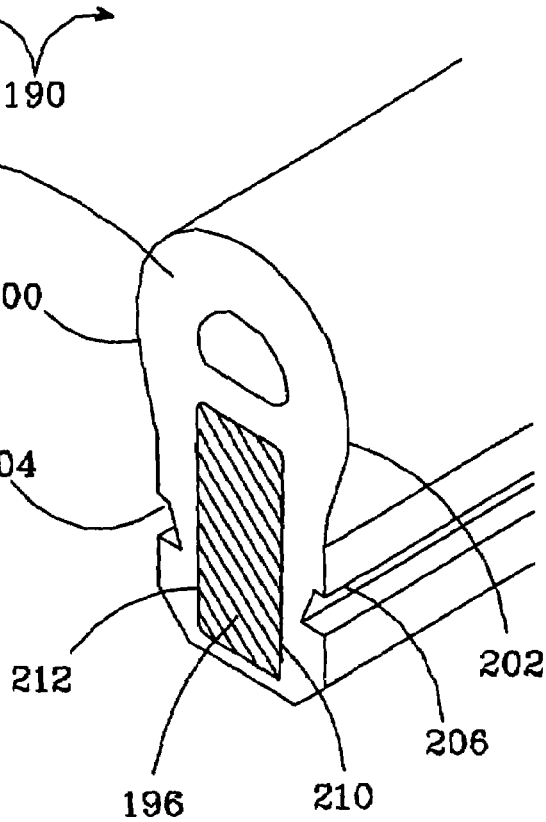
FIG. 17 is a perspective view of the lighting system shown in FIG. 16.

FIGS. 16 and 17 show another embodiment of a flexible lighting system 190 according to the present invention that is similar to the lighting system 130 described above in conjunction with FIGS. 10 and 11. The lighting system 190 comprises an extrusion 192 and a printed circuit assembly 194 in the extrusion's longitudinal cavity 196. The extrusion 192 has a top rounded surface and first and second sides 200, 202 with first and second mounting grooves 204, 206. The printed circuit assembly 194 is arranged vertically in the longitudinal cavity 196 and comprises light sources 208 (preferably LEDs) mounted to a flexible printed circuit material 210 such that light from the LED is directed primarily through the top surface 198. The printed circuit material 210 is adjacent to one of the vertical surfaces of the longitudinal cavity 196.

The lighting system 190 also comprises a strip 212 of material in the longitudinal cavity 196, on the cavity's vertical surface opposite the printed circuit material 210. The light sources 208 are sandwiched between the strip 212 and material 210, with both the strip 212 and material 210 being essentially opaque. The longitudinal cavity 196 can then be filled with a commercially available silicone potting material. In operation, light from the light sources 208 that emits toward the extrusion side surfaces 200, 202 is blocked from emitting through the side surfaces 200, 202 by the strip 212 and the printed circuit material 210. This essentially prevents lighting hot spots along the extrusions side surfaces 200, 202, with the LED light emitting through the top surface 198. Many different materials can be used for the strip 212, with a suitable material being grey silicone, and the strip can be arranged in different location or integral with the printed circuit assembly 194.

Figure 18:
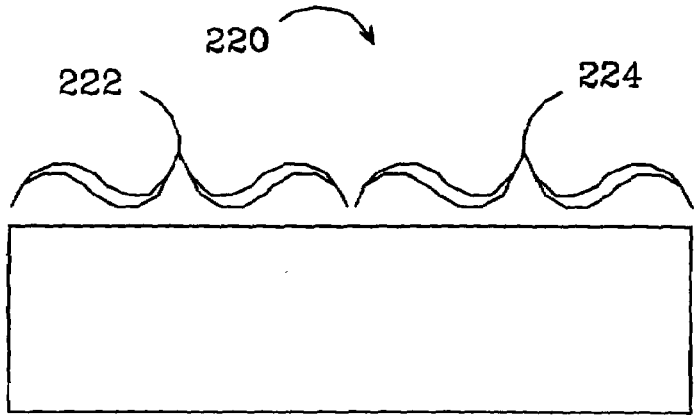
FIG. 18 is a plan view of one embodiment of a joint rod according to the present invention.
Figure 19:
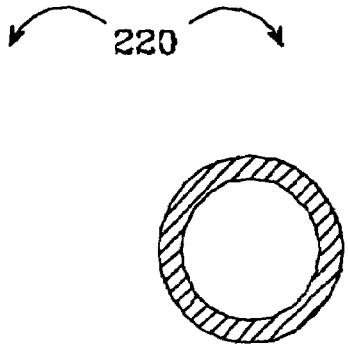
FIG. 19 is an end view of the joint rod in FIG. 18.
Figure 23:
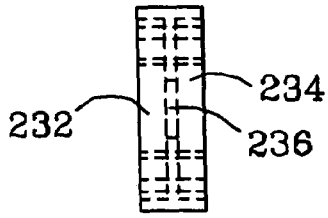
FIG. 23 is a top view of the butt joint fitting in FIG. 20.
Figure 20:
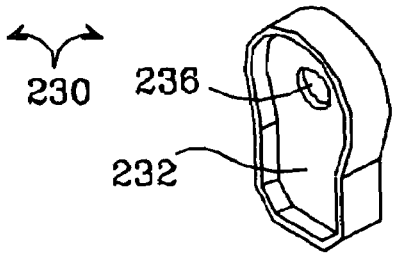
FIG. 20 is a perspective view of one embodiment of a butt joint fitting according to the present invention.
Figure 22:
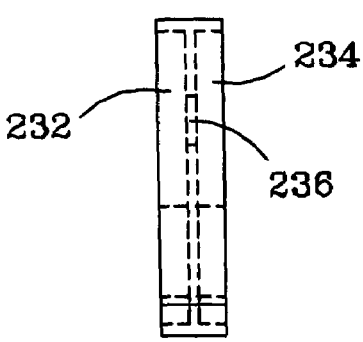
FIG. 22 is a side plan view of the butt joint fitting in FIG. 20.
Figure 21:
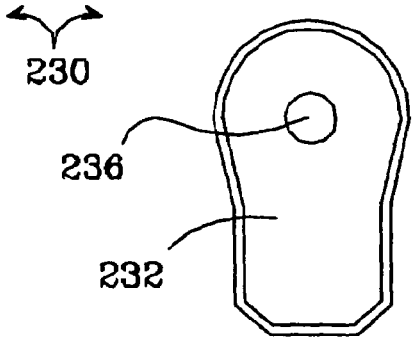
FIG. 21 is a front plan view of the butt joint fitting shown in FIG. 20.
Figure 27:
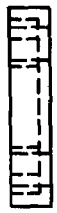
FIG. 27 is a top view of the end cap in FIG. 24.
Figure 24:
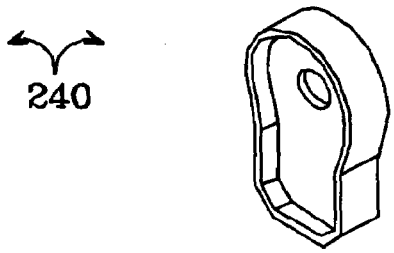
FIG. 24 is a perspective view of one embodiment of an end cap according to the present invention.
Figure 26:
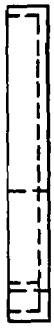
FIG. 26 is a side plan view of the end cap in FIG. 24.
Figure 25:
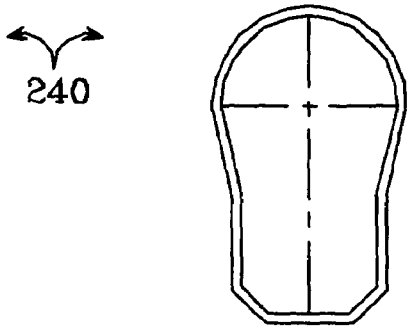
FIG. 25 is a front plan view of the end cap in FIG. 24.

As described above, a number of flexible lighting systems according to the present invention can be mounted end-to-end in a daisy-chain to illuminate a structural feature or to form a sign. FIGS. 18 and 19 show one embodiment of a joint tube 220 according to the present invention that is used at the junction between the systems to provide a rugged as essentially seamless joint. The tube is sized to fit in the upper cavities of the extrusions, such as the upper cavity 20 of extrusion 12 shown in FIGS. 1 and 2. A first portion 222 of the tube 220 is inserted into the upper cavity of one extrusion and the remaining second portion is inserted into the upper cavity of the next extrusion on line, with the portions 222, 224 being approximately half of the tube 220. The ends of the extrusions can then be primed and glued together, with the tube 220 embedded in the extrusions.

The joint tube 220 has a diameter that allows it to fit closely within the upper cavities of the extrusions, while not deforming the extrusions, with a suitable diameter being approximately ¼ of an inch. The tube 220 also is also long enough to effectively hold the extrusions together, while not interfering with the flexing of adjacent extrusion, with a suitable length being approximately 1 inch. It is understood that the tube can have many different diameters and lengths according to the present invention. The tube 220 can also be made of many different materials with many different colors, with a preferred rod being made of clear vinyl material. In other embodiments, a joint rod can be used in the same way as a joint tube, with a preferred joint tube being made of acrylic or plastic.

FIGS. 20 through 23 show one embodiment of a butt joint fitting 230 according to the present invention that can also be included between end-to-end flexible lighting systems. The fitting 230 essentially comprises first and second halves 232, 234, with the first half 232 sized to fit over the end of one extrusion and the second half 234 sized to fit over the next extrusion in line. The halves 232, 234 can be glued over their respective extrusion end to bond the extrusions together in the joint fitting 230. The joint fitting 230 also has a rod hole 236 to allow the joint rod 220 (shown in FIGS. 18 and 19) to be passed between end-to-end extrusions, through the joint fitting 230.

The joint fitting 230 can be made of many different materials, with a preferred material being silicone rubber. It can also be many different colors but is preferably clear so that the light from the lighting systems can pass through the joint fitting 230. During operation the fitting is essentially undetectable and provides a durable connection point between end-to-end lighting systems, particularly when used with the joint rod 220.

FIGS. 24 through 27 show one embodiment of an end cap 240 according to the present invention that is sized to fit over the ends of the flexible lighting systems. The end cap 240 can have different sizes and shapes to fit over the ends of the different sized and shaped extrusions according to the present invention. The end cap can be bonded in place over the end of an extrusion for protection and to cover the extrusion's cavities, such as the upper and longitudinal cavities 20 and 16 shown in FIGS. 1 and 2. The end cap 240 can be made of many different materials with different colors, but is preferably made of silicone rubber having the same color as its extrusion. When in place, the end cap 240 provides protection while giving a finished appearance to the lighting systems.

Figure 28:
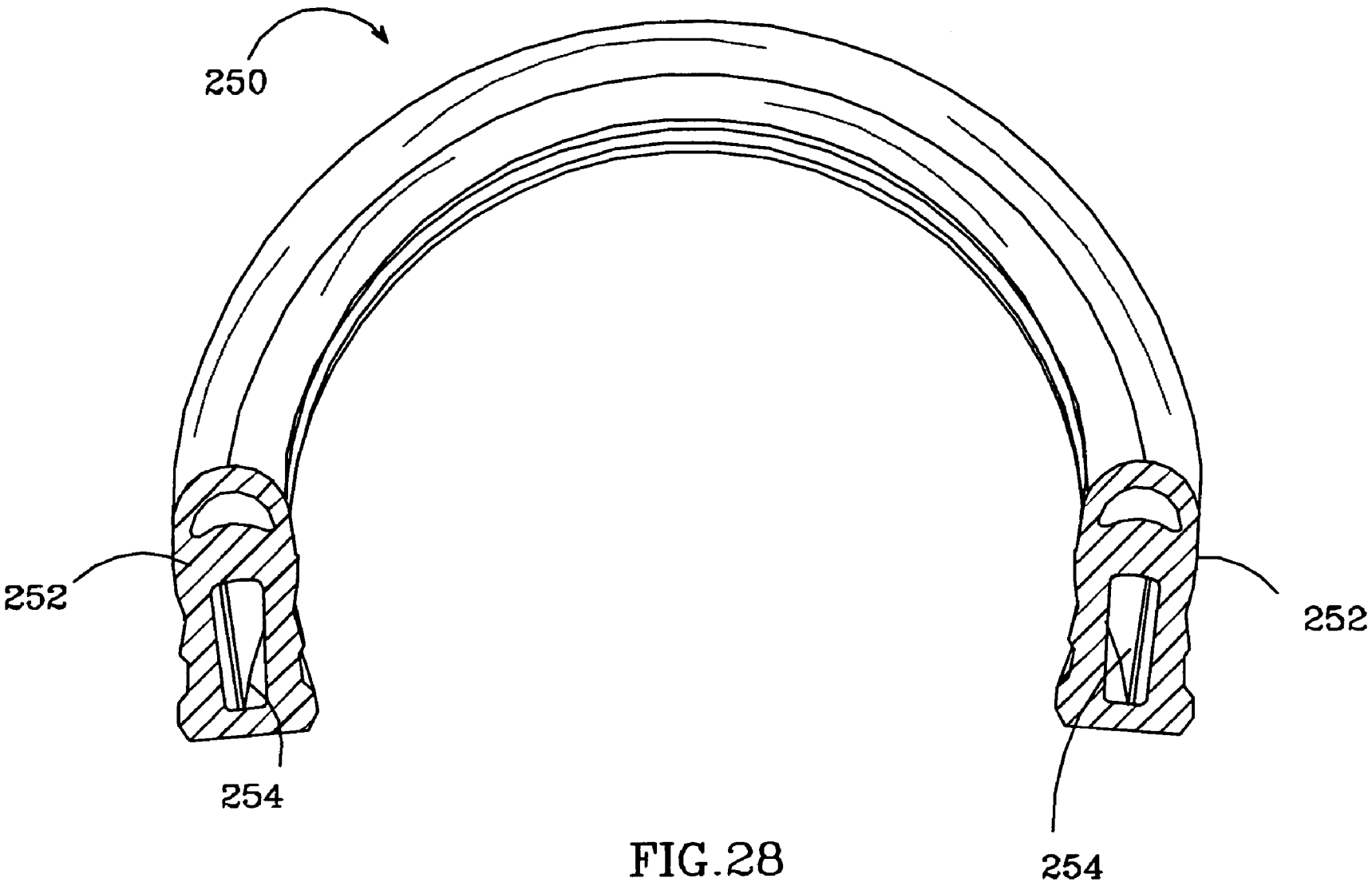
FIG. 28 is a perspective view of an embodiment of a flexible lighting system according to the present invention, flexed in the vertical plane.

FIG. 28 shows a flexible lighting system 250 according to the present invention, which is bent to a desired curvature. The extrusion 252 is made of flexible material so that it can be flexed under a minimal force, such as by hand, and will then return back to straight when the force is removed. The extrusion can withstand repeated bending without experiencing a failure. The printed circuit assembly 254 has LEDs and electronic components mounted on a flexible printed circuit material that has conductive traces to interconnect the LEDs and electronic components. The circuit assembly 254 is mounted vertically, which allows the lighting system 250 to be bent to very small radiuses in the horizontal plane. It can also be bent in the vertical plane, although because of the orientation of the printed circuit assembly 254, it cannot be bent to as small a radius.

Figure 29:
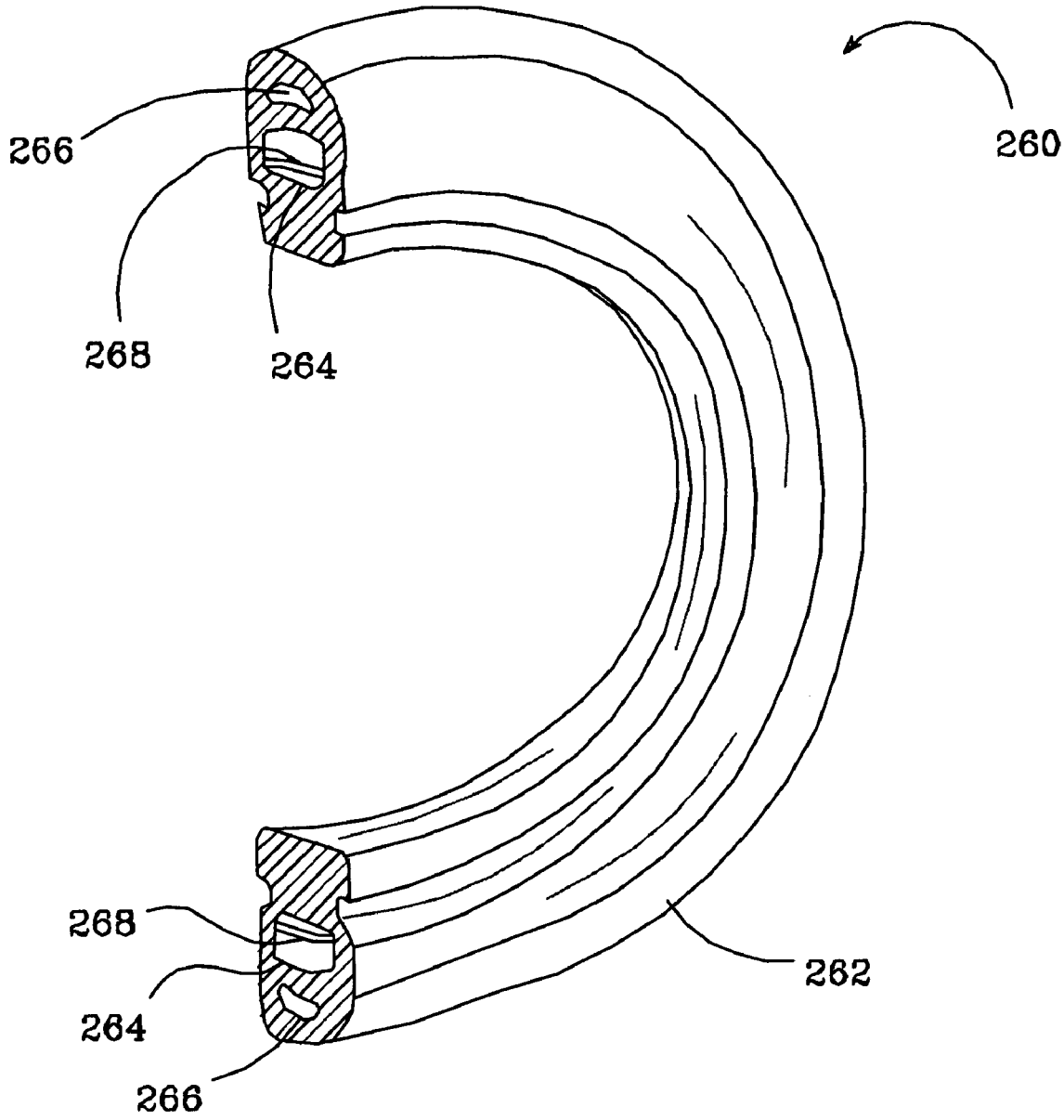
FIG. 29 is a perspective view of an embodiment of a flexible lighting system according to the present invention, flexed in the vertical plane.

FIG. 29 shows another embodiment of a flexible lighting system 260 according to the present invention that can be flexed to smaller radiuses in the vertical plane. It comprises an extrusion 262 that is made of a material such as silicone, and includes a lower cavity 264 and an upper cavity 266. The lower cavity 264 holds a printed circuit assembly 268, usually sealed in a potting material, and the upper cavity 266 provides secondary optics to diffuse light passing through it. In lighting system 260, however, the printed circuit assembly 268 is horizontally oriented. This arrangement allows for small flexing radiuses in the vertical plane, with not as small of flexing radiuses in the horizontal plane. Other printed circuit assembly arrangements allow for small flexing radiuses in planes between horizontal and vertical, and allow for small flexing radiuses in multiple planes. The system 260 can also comprise two opaque strips (not shown) on the sides of the lighting elements to block light emitting out the side surfaces of the extrusion 262.

Figure 30:
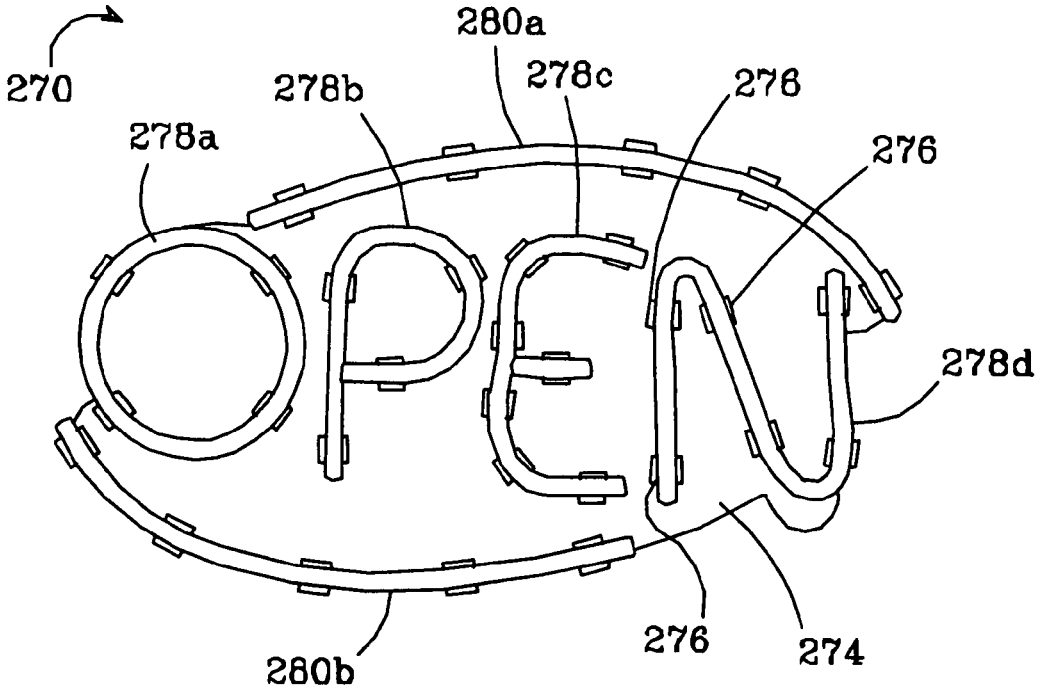
FIG. 30 is one embodiment of a sign using flexible lighting systems according to the present invention.

FIG. 30 shows one embodiment of a sign 270 constructed using flexible lighting systems according to the present invention to form sign features, such as illuminated sign letters and/or illuminated borders. The sign 270 can comprise a base 274 onto which mounting brackets 276 are mounted in the locations for forming letters 278*a-d* and borders 280*a-b*. Lighting systems can then be cut in the field to the appropriate length to form the letters 278*a-d* and borders 280*a-b*. The lengths are then snapped into the brackets 276 and the lengths are electrically daisy-chained together by conductors (not shown). Power is then supplied to the lengths to illuminate the LEDs within each of the lengths.

Figure 31:
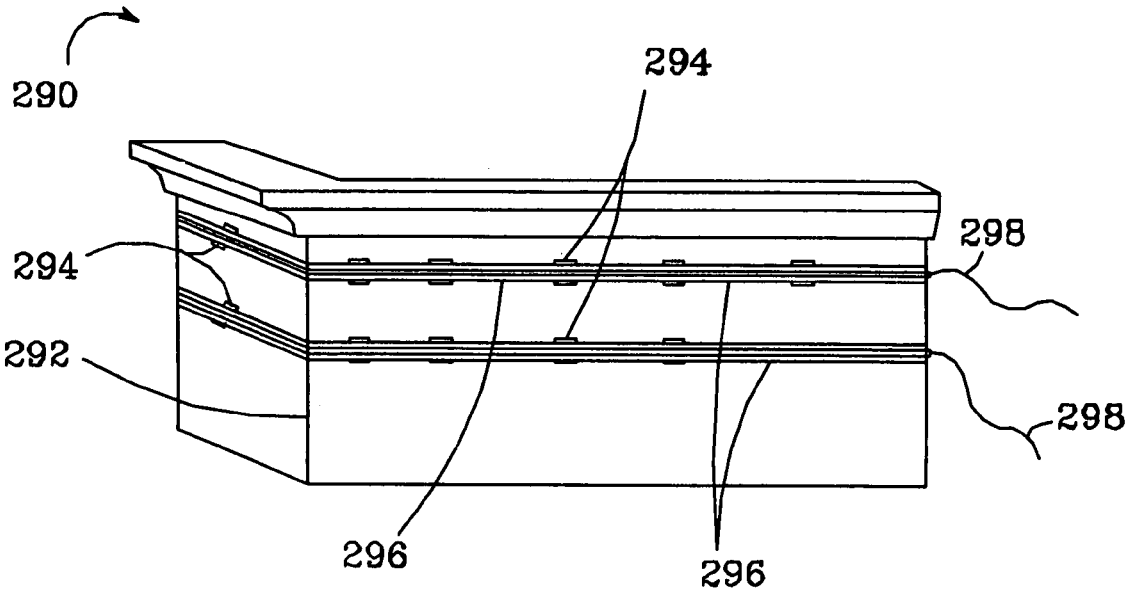
FIG. 31 is one embodiment of a structural feature using flexible lighting systems according to the present invention.

FIG. 31 shows one embodiment of daisy-chained lighting system 290 according to the present invention used to illuminate a structural feature 292. Before mounting the lights, the mounting brackets 294 are affixed to the structural feature 292 at intervals along a line where the lighting system is to be attached. The individual flexible lighting systems 296 can be snapped into the brackets 294 to fix the lighting systems 296 in place. More than one of the light systems 296 can be daisy-chained to light a longer structural feature with power applied to the lighting systems along conductor 298. The lighting systems 296 can also be mounted along curved structural features.

FIGS. 30 and 31 show use of flexible perimeter lighting according to the present invention in illuminated signs and for structural perimeter lighting. There are, however, many other applications for the perimeter lighting including, but not limited to, automotive accent lighting, safety lighting, pool, spa and fountain lighting, as well as many other uses.

Although the present invention has been described in considerable detail with reference to certain preferred configurations thereof, other versions are possible. The printed circuit assembly can be mounted in many different ways integral to the extrusion. The light sources can be mounted within the extrusion without the printed circuit material. The extrusion can be many different shapes and colors and can be more than one color. Therefore, the spirit and scope of the invention should not be limited to their preferred versions described above.

We claim:

1. An elongated flexible lighting system, comprising:

an array of light sources illuminated by electric power, said array cuttable at intervals to shorten said array while allowing the remaining light sources in said array to emit light;

an elongated translucent extrusion of flexible material, said flexible material bendable upon application of a bending force and capable of returning to a straight configuration when said bending force is removed, said array of light sources integral to said extrusion, said extrusion transmitting and dispersing the light from said array such that the individual light sources within said array are not visible as individual light sources when illuminated, giving the appearance said array of light sources is a continuous light source.

2. The lighting system of claim 1, wherein said extrusion is cuttable to match the length of said array.

3. The lighting system of claim 1, wherein said array of light sources comprises an array of light emitting diodes (LEDs).

4. The lighting system of claim 3, wherein said array of LEDs comprises a linear array of LEDs.

5. The lighting system of claim 3, wherein said array of LEDs comprises a plurality of parallel connected sub-arrays of LEDs, said electric power coupled across each of said plurality of sub-arrays.

6. The lighting system of claim 5, further comprising a plurality of voltage regulators each of which is at a respective one of said parallel connected sub-arrays, each of said voltage regulators providing a substantially similar voltage to said respective sub-array.

7. The lighting system of claim 5, wherein said array of LEDs is cuttable between adjacent ones of said plurality of parallel connected sub-arrays.

8. The lighting system of claim 1, further comprising a mounting means.

9. The lighting system of claim 8, wherein said mounting means comprises a bracket.

10. The lighting system of claim 8, wherein said extrusion further comprises one or more longitudinal grooves, said mounting means comprising a bracket having one or more lips, each said lip arranged to mate with a respective one of said grooves to hold said extrusion within said bracket.

11. The lighting system of claim 1, further comprising means for conducting said electrical power from said lighting system to another device.

12. The lighting system of claim 1, further comprising a flexible printed circuit material integral to said extrusion, wherein said array of light sources are mounted on said flexible printed circuit material.

13. The lighting system of claim 12, wherein said flexible printed circuit material is vertically mounted integral to said extrusion, said light sources emitting out the top of said extrusion.

14. The lighting system of claim 13, further comprising an opaque strip in proximity to said flexible printed circuit material, said light sources arranged between said strip and printed circuit material and said strip and printed circuit material blocking light from emitting out the sides of said extrusion.

15. The lighting system of claim 12, wherein said flexible printed circuit material is horizontally mounted integral to said extrusion, said light sources emitting out the top of said extrusion.

16. The lighting system of claim 15, further comprising two opaque strips arranged on opposite sides of said light sources to block light from emitting out the sides of said extrusion.

17. The lighting system of claim 1, wherein said extrusion comprises silicone.

18. The lighting system of claim 1, wherein said extrusion further comprises a longitudinal cavity, light from said light sources passing through and dispersed by said cavity.

19. An elongated flexible lighting system, comprising:

a plurality of light emitting diodes (LEDs) to emit light in response to electrical power;

a plurality of electrical power regulators arranged so each of said plurality of LEDs is driven by substantially the same electrical power;

an elongated translucent extrusion of flexible material comprising a first and second longitudinal cavity, said flexible material bendable upon application of a bending force and capable of returning to a straight configuration when said bending force is removed, said plurality of LEDs mounted in said first longitudinal cavity and capable of transmitting at least some light through at least some of said extrusion, said second longitudinal cavity capable of diffusing at least some of said light and said extrusion dispersing the light from said array giving the appearance that said array of light sources is a continuous light source.

20. The lighting system of claim 19, wherein some of said plurality of LEDs can be separated from the others of said plurality of LEDs, the remaining of said plurality of LEDs emitting light.

21. The lighting system of claim 19, wherein said array of LEDs comprises a plurality of parallel connected sub-arrays of LEDs, said electric power coupled across each of said plurality of sub-arrays, each of said electrical power regulators driving a respective one of said sub-arrays.

22. The lighting system of claim 19, wherein each of said electrical power regulators is a voltage regulator.

23. The lighting system of claim 19, further comprising a flexible printed circuit material integral to said extrusion, wherein said LEDs are mounted on said flexible printed circuit material.

24. The lighting system of claim 19, wherein said first longitudinal cavity is filled with a potting material.

* * * * *